US008822805B2

(12) United States Patent
Miniaev

(10) Patent No.: US 8,822,805 B2
(45) Date of Patent: Sep. 2, 2014

(54) MUSICAL INSTRUMENT

(75) Inventor: Viacheslav Miniaev, Overland Park, KS (US)

(73) Assignee: Eliton, LLC, Overland Park, KS (US)

( * ) Notice: Subject to any disclaimer, the term of this patent is extended or adjusted under 35 U.S.C. 154(b) by 211 days.

(21) Appl. No.: 13/074,908

(22) Filed: Mar. 29, 2011

(65) Prior Publication Data

US 2012/0055318 A1 Mar. 8, 2012

Related U.S. Application Data

(63) Continuation-in-part of application No. 12/123,305, filed on May 19, 2008, now Pat. No. 7,915,505.

(60) Provisional application No. 61/453,889, filed on Mar. 17, 2011, provisional application No. 60/938,676, filed on May 17, 2007, provisional application No. 61/052,219, filed on May 11, 2008.

(51) Int. Cl.

| | |
|---|---|
| ***G10H 1/32*** | (2006.01) |
| ***G10H 3/00*** | (2006.01) |
| ***G10H 3/14*** | (2006.01) |

(52) U.S. Cl.

CPC ..... *G10H 1/32* (2013.01); *G10H 2220/525* (2013.01); *G10H 2230/085* (2013.01); *G10H 3/146* (2013.01)

USPC ..... 84/743; 84/730

(58) Field of Classification Search

USPC ..... 84/291, 294, 731, 743

See application file for complete search history.

(56) References Cited

U.S. PATENT DOCUMENTS

| | | | | |
|---|---|---|---|---|
| 1,699,384 | A * | 1/1929 | Welch | 84/274 |
| 3,595,981 | A * | 7/1971 | Hopping | 84/726 |
| 4,064,965 | A * | 12/1977 | Brown | 181/131 |
| 4,112,809 | A * | 9/1978 | Sjostrand et al. | 84/465 |
| 4,232,582 | A * | 11/1980 | Diamond | 84/267 |
| 4,428,268 | A * | 1/1984 | Ingoglia | 84/726 |
| 4,748,886 | A * | 6/1988 | De Byl | 84/723 |
| 4,770,079 | A * | 9/1988 | Mastroianni | 84/291 |
| 4,949,619 | A * | 8/1990 | Freiherr von Maltzan | 84/723 |
| 4,995,293 | A * | 2/1991 | Anderson | 84/733 |
| 5,010,803 | A * | 4/1991 | Donnell | 84/743 |
| 5,072,646 | A * | 12/1991 | Valkama | 84/726 |
| 6,255,565 | B1 * | 7/2001 | Tamura | 84/275 |
| 6,441,292 | B1 * | 8/2002 | Donnell | 84/723 |
| 6,646,190 | B2 * | 11/2003 | Brown | 84/291 |
| 6,646,191 | B1 * | 11/2003 | Martin | 84/291 |
| 6,664,461 | B2 * | 12/2003 | Tamura | 84/743 |
| 6,791,022 | B2 * | 9/2004 | Green | 84/731 |
| 7,247,789 | B2 * | 7/2007 | Fishman et al. | 84/723 |
| 7,514,614 | B2 * | 4/2009 | McGrew | 84/291 |
| 7,844,069 | B2 * | 11/2010 | Banks | 381/361 |
| 8,258,392 | B2 * | 9/2012 | Mori | 84/730 |
| 2007/0028752 | A1 * | 2/2007 | McGrew | 84/726 |
| 2008/0205669 | A1 * | 8/2008 | Michelet | 381/118 |

* cited by examiner

*Primary Examiner* — Jeffrey Donels

(74) *Attorney, Agent, or Firm* — Kutak Rock LLP; Bryan P. Stanley

(57) ABSTRACT

A musical instrument and acoustic/electrical pickup is provided. The instrument includes acoustic and/or electrical pickup capabilities but also retains the feel of an acoustic instrument. The pickup is removable from the instrument.

24 Claims, 3 Drawing Sheets

MUSICAL INSTRUMENT

CROSS-REFERENCE TO RELATED APPLICATIONS

This application claims priority pursuant to 35 U.S.C. 119 (e) to then U.S. Provisional Patent Application Ser. No. 61/453,889, filed Mar. 17, 2011, and also is a continuation-in-part to U.S. patent application Ser. No. 12/123,305, filed May 19, 2008 and which claimed priority pursuant to 35 U.S.C. 119(e) to then U.S. Provisional Patent Application Ser. No. 60/938,676, filed May 17, 2007, and to then U.S. Provisional Patent Application Ser. No. 61/052,219, filed May 11, 2008, the entire disclosures of which are incorporated herein by reference.

FIELD OF THE INVENTION

The present invention relates generally to a musical instrument, such as a cello. More specifically, the present invention is concerned with an electric instrument, and/or an acoustic/electric pickup for a musical instrument, such as a cello. In preferred embodiments, the musical instrument is portable, folding, lightweight and acoustically accurate. This application discloses alternative embodiments to the invention previously disclosed in co-pending U.S. patent application Ser. No. 12/123,305, filed May 19, 2008 and which claimed priority pursuant to 35 U.S.C. 119(e) to then co-pending U.S. Provisional Patent Application Ser. No. 60/938,676, filed May 17, 2007, and to then co-pending U.S. Provisional Patent Application Ser. No. 61/052,219, filed May 11, 2008, the entire disclosures of which are incorporated herein by reference.

BACKGROUND OF THE INVENTION

The violoncello, usually abbreviated as a cello, dates back to 1660 and is a member of the violin family. It is a four string instrument that produces a deep, rich, and vibrant sound. The cello reaches a pitch between the viola and the double bass. The cello has evolved throughout the years and the first cellos were larger than today's cellos. The cello size was standardized in the mid-1700's to the size and shape and string number that it has today.

A conventional cello usually consists of a body; four strings; a neck, pegbox and scroll; a tailpiece and endpin; a bridge and f-holes. A bow is then pulled across the strings to make the sound. The main frame of the cello is typically made from wood, although some modern cellos are constructed from carbon fiber or laminate. The cello body has a wide top bout, narrow middle formed by two c-bouts, a wide bottom bout, with the bridge and sound holes just below the middle. The top and back of a cello are traditionally hand-carved but can be machine-produced.

Above the main body is the carved neck of the instrument which leads to a pegbox and scroll. The neck, pegbox, and scroll are normally carved out of a single piece of wood, such as, for example, maple. Attached to the neck and extending over the body of the instrument is the fingerboard. The nut is a raised piece of wood, where the fingerboard meets the pegbox, and on which the four strings rest with corresponding tuning pegs housed in the pegbox. The pegs are used to tune the cello by either tightening or loosening the string. The scroll is simply a decorative part of a traditional cello.

At the lower part of the cello is the tailpiece and the endpin. The tailpiece attaches the strings to the lower end of the cello and can have fine tuners as well. The endpin supports the cello in playing position. The tailpiece is traditionally made of ebony or other hard wood but can also be made of plastic or steel. The endpin can be retractable and adjustable to the individual player and is usually made of wood, metal, or another suitable material.

The bridge elevates the strings above the cello and transfers the vibrations to the top of the instrument to the soundpost located inside the instrument. Located on either side of the bridge are the f-holes which allow air to move in and out of the instrument to produce sound. Finally, a bow is pulled across the strings to vibrate the strings and emit sound from the cello.

The basic make and shape of the cello has not changed for hundreds of years. As musicians have become more mobile and transportation has changed from train to airplane travel, so has the desire to have a cello that is easily transported. A traditional cello is easily damaged when traveling. Being tossed around can damage the instrument on the outside but more importantly can effect the integrity and sound of the instrument. Additionally, a traditional cello is large and difficult to transport on an airplane. As security on airplanes has heightened, airlines will not allow instruments to be carried onto an airplane unless a separate ticket is purchased for the instrument if it will not fit in the overhead compartment. This means that the cello in its case has to be checked with other baggage, which opens up the possibility for damage. Portable cellos have appeared in the market, but such instruments are still relatively heavy and large. Also, due to the design and materials used to make portable cellos, such instruments do not sound and, more importantly, feel like a traditional cello. Therefore, it would be beneficial to provide a cello that is lightweight and portable and that maintains the feel of a traditional acoustic cello. Further, since travel has become such a large part of a performing musicians' life it would be beneficial to provide a cello that travels easier and that also can be used to practice without disturbing others because it is like a quiet cello.

With the introduction of the electro-magnetic pickup and piezoelectric pickups electric instruments emerged, including the electric cello. The problem with these types of cellos is that the feel and the sound do not imitate an acoustic cello. Therefore, it would be beneficial to provide an electric cello (or other instrument), and/or an electric pickup for a musical instrument, that has the feel of a traditional acoustic cello (or other instrument).

SUMMARY OF THE INVENTION

An object of the present invention is to provide a musical instrument that is light weight and portable. Another object of the invention is to provide an electric instrument that has the feel of an acoustic instrument. Yet another object of the invention is to provide an instrument, or a pickup for an instrument, that allows for electronic amplification of sounds. Another objection of the invention is to provide an instrument, or a pickup for an instrument, that allows for electronic amplification of sounds while having the feel of an acoustic instrument.

The objects of the instant invention are accomplished through the use of a pickup that includes a connection member connecting a pickup body or chamber to the body (soundboard, etc.) of an instrument. The connecting member is connected to a membrane or diaphragm located within the pickup body. The connection member transmits vibrations from the body of the instrument to the membrane via the connection member. A microphone head or other electronic pickup device is located within the pickup body to pick up the sound vibrations generated on the membrane. The size and shape of the body of the pickup is selected by a person of ordinary skill in the art to provide the desired sound quality from the membrane to the pickup. The pickup body includes an opening or port to allow sound waves to exit the pickup body into a flexible tube that is connectable to acoustic headphones to provide an acoustic pickup. In a preferred embodiment, the pickup is mounted within an insulating material within the musical instrument to prevent or at least minimize the effect of sound waves from entering the pickup body chamber from any locations other than the membrane. In another embodiment, the pickup body is made of a sound-insulating material.

In one preferred embodiment, the instrument is a folding cello. Nevertheless, it will be appreciated that the pickup of the instant invention may be utilized in connection with any instrument other than a cello, and with folding and traditional non-folding instruments. The pickup of the instant invention may be built into the instrument or alternatively may be removably mounted to the instrument, such as with a mounting bracket.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of the invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION OF THE DRAWINGS

A preferred embodiment of the invention, illustrative of the best mode in which the applicant has contemplated applying the principles, is set forth in the following description and is shown in the drawings.

FIG. 1 shows the soundboard removed with the pickup body mounted centrally within the instrument body.

FIG. 2 shows the pickup body below the soundboard below the bridge of the instrument, with the connecting member contacting the bottom of the soundboard.

DETAILED DESCRIPTION OF A PREFERRED EMBODIMENT

Figure 1:
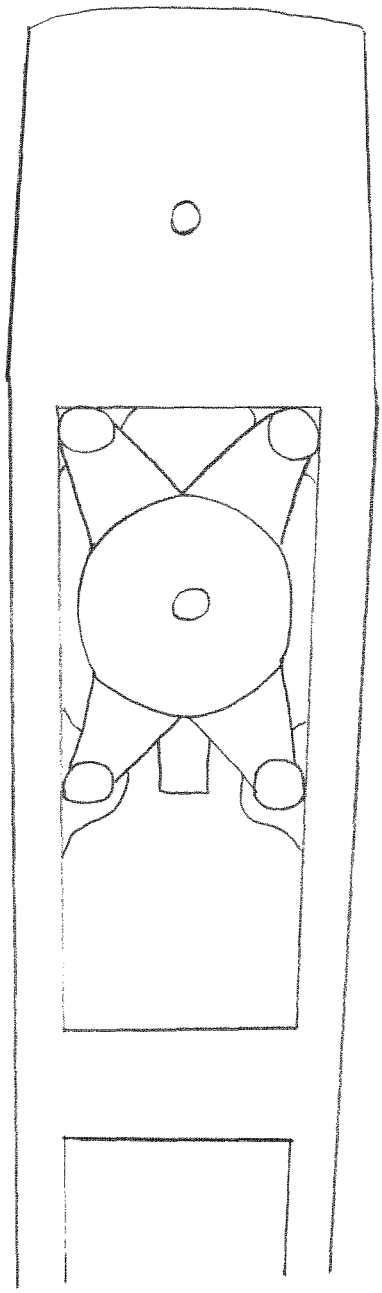
FIG. 1 is a partial top view of the body of a cello in which a pickup of an embodiment of the instant invention is mounted below a soundboard.

As required, a detailed embodiment of the present inventions is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The Figures shown and described in U.S. patent application Ser. No. 12/123,305 show a cello in which the pickup of the instant invention may be incorporated. Nevertheless, it will be appreciated that the pickup of the instant invention may be incorporated into other instruments and/or may be a separate, removably attachable piece that can be mounted (such as via a mounting bracket) to a variety of different instruments.

In one embodiment of the invention, a folding cello is designed to correspond to a full size (4/4) acoustic cello when unfolded, as shown and described in U.S. patent application Ser. No. 12/123,305. Similarities between a standard acoustic cello and folding cello include, but are not limited to, the following: the distance of a vibrating string from the nut to bridge of the instrument; the dimensions of the neck; the dimensions of the fingerboard; the angle and the angular adjustment of the instrument; the position of chest support; and the location and configuration of upper bout support. These similarities create the feel of an acoustic cello when held and played by a musician.

In the preferred embodiment of cello, a bridge stands on a soundboard that is suspended using springs or other suitable components/connectors (such as rubber, sponge, etc.) to allow the soundboard to vibrate independent of cello body. This differs from traditional electric stringed instruments in which the bridge stands on a solid body of the instrument. In a preferred embodiment, the soundboard is suspended such that it is not fully compliant, meaning that a portion of the soundboard is fixedly connected to the body of the instrument while the soundboard is supported/suspended by the springs. It will be appreciated that the arrangement and number of springs may be manipulated by a person of ordinary skill in the art to appropriately tune the instrument to provide the desired feel. The addition of the suspended soundboard gives the musician the feeling of an acoustic instrument. Further, sound manipulation and control equals that of an acoustic cello. Touch and feel are important to a musician and one problem with previous types of portable cellos, including electric cellos, is that they do not feel like an acoustic cello. As musicians have become more mobile it is important for them to be able to practice and not lose the muscle memory and other important aspects of playing an instrument. Therefore, it is important to have an instrument that feels like the instrument the musician is used to playing. As a musician progresses in skills this becomes even more important. The suspended soundboard allows for a folding cello to feel like an acoustic cello. In one preferred embodiment a carrying case, either of a soft or hard construction, is provided to fit the folding cello and a bow.

Due to the suspended soundboard's ability to deliver precise sound manipulation the instrument requires a similarly precise pickup. Two types of pickups commonly used are the electromagnetic pickup and the piezoelectric pickup, although it will be appreciated that other types of pickups may be used without departing from the spirit and scope of the instant invention. A problem with electromagnetic and piezoelectric type pickups is that such pickups convert acoustic vibrations into electric signals, significantly reducing the sound quality. In several embodiments of the instant invention, an acoustic pickup is attached to the body of the folding cello. The acoustic pickup is coupled to the underside of the soundboard with a tubing material attached to the acoustic pickup that stretches from the acoustic pickup toward the upper portion of the instrument body. In one embodiment, the acoustic pickup comprises a stethoscope end (or other apparatus manufactured in a manner and to provide sound detection similar that of a stethoscope) coupled to the underside of the soundboard. In one embodiment, the tubing material includes an end that is located in or otherwise attached to the instrument body such that the musician can attach a set of headphones or other similar devices to the end of the tubing material. The tubing material delivers acoustic vibrations directly to the musician's ears without losing quality or having electrical interference. The quality of the sound is better than traditional pickups because the vibrations are carried directly to the musician rather than being converted to electric signals. The acoustic pickup may be used with either floating or non-floating soundboard arrangements. The acoustic pickup generally includes, but is not limited to, the following features: (1) an airtight connection or coupler to headphones; (2) a tubing material that is flexible in nature (e.g. tubing of a stethoscope); (3) a microphone inside an airtight space within the tubing material or within a pickup body to which the tubing material is connected; (4) a hollow area within the body of the instrument; (5) the spring of the soundboard; (6) a solid material connector that provides a physical link from the soundboard to a diaphragm of the pickup; (7) the pickup diaphragm or membrane; (8) a stethoscope end piece/head; and (9) the soundboard.

The acoustic pickup utilizes the same concept as used by a medical stethoscope (which includes the stethoscope diaphragm within the stethoscope end piece) to capture and deliver the vibrations to the user's ears. In one embodiment, a set of acoustic headphones delivers the vibrations from the stethoscope of the acoustic pickup to the listener. The acoustic headphone set may be made using two identical stethoscope end/ear pieces serving as the right and left headphone. A headphone tubing is attached to the acoustic headphone set that is attachable to the tubing material of the acoustic pickup. In another embodiment, the acoustic headphone set may be a standard stethoscope headset without the stethoscope end/ear piece attached and using an alternative ear piece such as an ear-muff style ear piece. It will be appreciated that the headphone set of the instant invention may be constructed in various different ways using known materials that allow for the carrying of vibrations from the soundboard to the listener. The acoustic headphones provide an accurate transmission of the natural vibrations of the instrument that the acoustic pickup captures. The acoustic headphones are removably attached by attaching the tubing to or removing the tubing from a connector/coupling. A microphone (item 3 shown in FIG. 7 of U.S. patent application Ser. No. 12/123,305) inserted into the tubing allows for additional amplification of the sound. It will be appreciated that the acoustic pickup described herein may be utilized without the inclusion of a microphone. Furthermore, it will be appreciated that alternative arrangements (such as described herein below) for a microphone (or other electric pickups) may be utilized in which the pickup/microphone is not located within tubing. For example, in an embodiment of the instant invention described herein, the pickup/microphone is located in a pickup body to which the tubing is connected, shown in the FIGS. 1-6.

In another embodiment shown and described in FIG. 7 of U.S. patent application Ser. No. 12/123,305, a solid material connector links the soundboard to the stethoscope membrane. The solid material connector transfers the vibrations of the soundboard to the stethoscope membrane which in turn transfers the vibrations through the tubing material to the headphones. The solid material connector of one embodiment is made of a generally soft material, such as, for example, cork or rubber. In another embodiment, the solid material connector is made from a hard material, such as, for example, wood. A softer material used to make the solid material connector correlates with a softer sound. A harder material used correlates to a stronger and drier sound. Additionally, the size of the solid material connector changes the sound that is produced. It will be appreciated that the specific type of material and size of material used for the solid material connector to provide the desired sound and feel for any given instrument of the instant invention will be readily apparent to a person of ordinary skill in the art.

In another embodiment shown and described in FIG. 8 of U.S. patent application Ser. No. 12/123,305, the acoustic pickup is shown in connection with a flush-mounted sound board. Nevertheless, it will be a appreciated that the acoustic pickup of the instant invention may be utilized in connection with any soundboard arrangement, including flush-mount or non-flush mount, as well as non-floating or floating soundboard arrangements. In addition, it will be appreciated that in some embodiments, such as those shown in Exhibit B of U.S. Provisional Patent Application Ser. No. 61/453,889, filed Mar. 17, 2011, the pickup may be separately and removably mounted to the soundboard.

In the embodiment shown and described in FIG. 8 of U.S. patent application Ser. No. 12/123,305, the acoustic pickup of the instant invention is a head of a stethoscope; however, the acoustic membrane has been removed leaving only the open chamber of the stethoscope head. The outer-rim of head is attached to foam ring via glue or another suitable tacky substance (in the depicted embodiment, the foam itself is tacky in nature or includes the tacky substance). The foam ring is then attached directly to the rear side of the soundboard. This provides a direct connection between the rear of the soundboard and the interior of the chamber of the pickup body (i.e. the open part of the ring leaves the surface of the soundboard exposed to the interior of the chamber of the stethoscope pickup head). The tacky foam provides a hermetic (airtight) seal between the pickup body head and the soundboard. The head of the stethoscope is connected to a coupler via rubber tubing. A notch is cut in one of the instrument supports to allow the tubing to pass through toward the top of instrument body. A coupler is attached to the back of instrument body to allow a listener to plug headphones into the coupler without the need to remove the back cover/surface of instrument body.

The acoustic pickup does not limit the musician from using a traditional electronic pickup for sound amplification. In one embodiment shown in FIG. 9 of U.S. patent application Ser. No. 12/123,305, a piezoelectric pickup is attached to a soundboard of the folding cello. Other removably mountable piezoelectric pickup arrangements are shown and described in connection with Exhibit B of U.S. Provisional Patent Application Ser. No. 61/453,889. In the embodiment shown in FIG. 9 of U.S. patent application Ser. No. 12/123,305, the piezoelectric pickup is attached directly to the rear surface of the soundboard by glue or some other suitable means. The pickup is attached by sandwiching the piezoelectric pickup between the soundboard and a plate/cover member. In one embodiment, the plate/cover member is made of plastic, nevertheless it will be appreciated that other materials may be utilized without departing from the spirit and scope of the instant invention. A piece of foam is positioned between the plate and the piezoelectric pickup to reduce vibration/noise between the piezoelectric pickup and the plate (i.e. to isolate the pickup so that it only picks up vibrations from the soundboard to which it is directly in contact). Screws extend through the plate and into the soundboard to hold the plate in position. The screws are only used to hold the plate in position, and are only tightened down to a point prior to compressing the foam. The pickup is connected via a wire to a socket that extends through the back of instrument body to allow the pickup to be plugged into an amplifier or other electronic equipment.

In another embodiment, the instrument has a professional electronic sound refinement system, including but not limited to, a preamp, built-in effects, and other components generally known in the art.

Referring to FIG. 1, the body of a cello in which a pickup of an embodiment of the instant invention is mounted below a soundboard is shown. The soundboard is removed with the pickup body mounted centrally within the cello body. As shown in FIG. 1, the pickup is circular in shape with mounting brackets extending radially outward from the pickup body.

Figure 2:
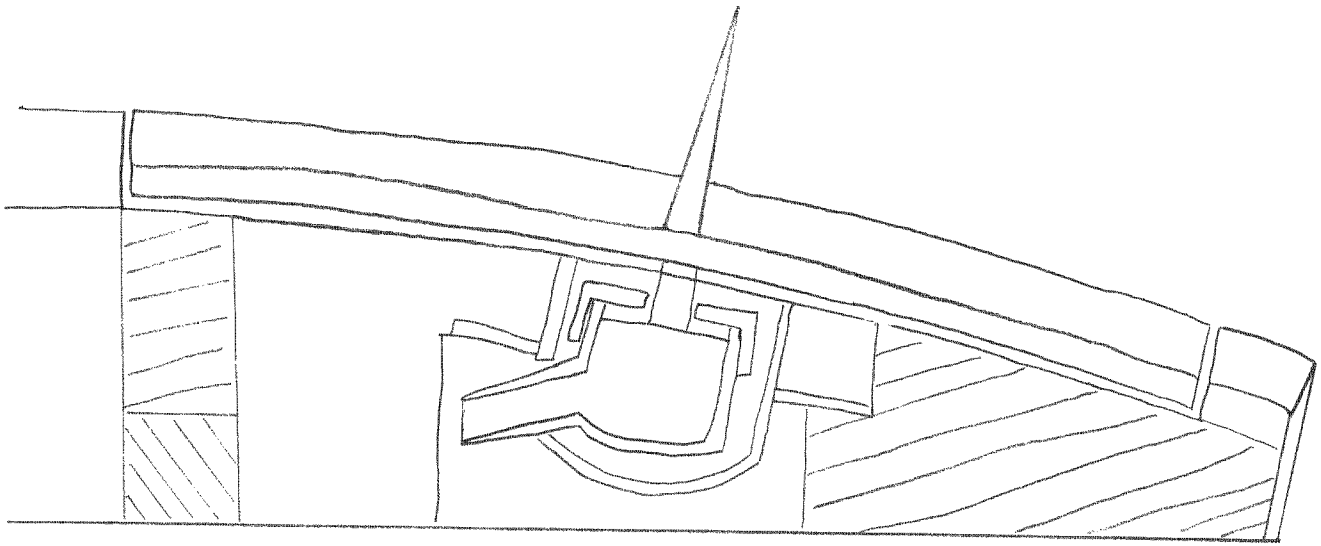
FIG. 2 is a side sectional view of the cello of FIG. 1.

Referring to FIG. 2, a cross section of the cello of FIG. 1 is shown from the side. FIG. 2 shows the pickup body below the soundboard and below the bridge of the instrument. The connecting member is in direct contact with the bottom of the soundboard. The connecting member is connected to a membrane or diaphragm of the pickup.

Figure 3:
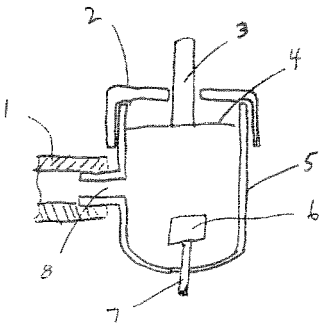
FIG. 3 is a side sectional view of an alternative embodiment of the pickup.
Figure 4:
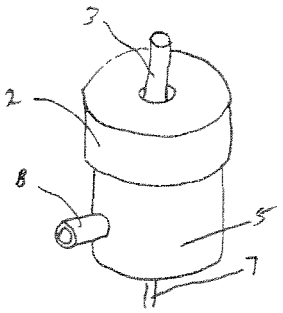
FIGS. 4 and 5 are perspective views of the embodiment shown in FIG. 3.
Figure 5:
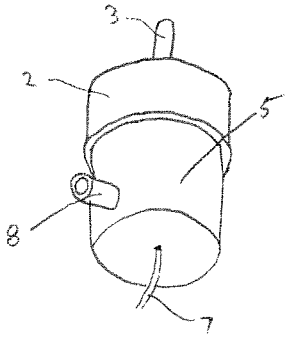
Figure 6:
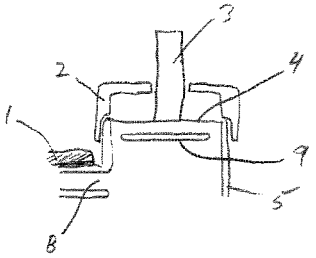
FIG. 6 is a partial side sectional view of another embodiment of the pickup.

Referring to FIGS. 3-6, various views and alternative embodiments of the pickup of FIG. 1 are shown, with the pickup removed and separate from the instrument. As is shown in FIG. 3, the pickup includes a pickup body member 5 and a cap 2 threadingly connected to the body member 5. The cap 2 includes a hole through which the connecting member 3 extends, as shown in FIGS. 3-4. When the pickup is connected to the instrument, as in FIG. 2, the connecting member attaches directly to the bottom of the soundboard. A small gap exists between the edge of the hole in the cap 2 and the connection member 3 to allow the connection member 3 to vibrate freely and independent of the cap 2. The size of the gap is maintained at a minimal size to prevent or reduce sound waves from entering the chamber of the pickup body 5 except through the connection member 3. A membrane 4 to which the connection member 3 is connected is held in place between the pickup body 5 and the cap 2 when the cap 2 is threaded to the body 5.

The body 5 includes a hole 8 or port to which a tubing 1 can be connected. This allows acoustic headphones to be connected to the pickup. A microphone 6 is located within the pickup body 5 to pick up the sound waves generated by the membrane 4. A cable 7 for the microphone 6 extends from the interior of the pickup body 5 out through a hole. In a preferred embodiment the cable hole is sized to provide a tight fit between the cable 7 and the edge of the hole and/or is otherwise insulated or sealed to prevent air pressure from escaping the chamber of the pickup body 5. In a preferred embodiment, air pressure exits the chamber formed by the body 5 and the membrane 4 through the port 8 for the acoustic headphones only. In a preferred embodiment the membrane is a mylar material, or other material similar to that used in stethoscopes. Nevertheless it will be appreciated that the material and/or thickness of the material may be varied to adjust sound quality. The size and shape of the chamber created by the pickup body 5 and membrane 4 along with the size of the port 8 for the acoustic headphones may be varied by a person of ordinary skill in the art to provides the desired pressure level inside the chamber for the electric pickup and acoustic headset qualities.

In alternative embodiments shown in FIG. 3, the membrane 4 includes a piezoelectric material which functions as the pickup/microphone along with the membrane functions discussed above. In other embodiments shown in FIG. 6, a fixed back plate is located under the membrane 4, within the chamber of the pickup body 5, to use with an electronic condenser contact microphone.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the invention is by way of example, and the scope of the invention is not limited to the exact details shown or described.

Although the foregoing detailed description of the present invention has been described by reference to an exemplary embodiment, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall with in the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed is:

1. A pickup for a musical instrument comprising:

a pickup body with a cavity;

a membrane forming at least a portion of a wall of said cavity; and a connection member to directly connect the musical instrument to said membrane, wherein said pickup body further comprises a microphone head.

2. The pickup as claimed in claim 1, wherein said connection member allows said membrane to vibrate independent of a body of the musical instrument.

3. The pickup as claimed in claim 2 wherein said body is removably connected to the body of the instrument via a mounting bracket.

4. The pickup as claimed in claim 1 wherein said connection member comprises a lightweight and hard solid material.

5. The pickup as claimed in claim 4 wherein said solid material comprises wood.

6. The pickup as claimed in claim 5 wherein said wood comprises spruce.

7. The pickup as claimed in claim 1, wherein said connection member comprises a lightweight and soft solid material.

8. The pickup as claimed in claim 7, wherein said solid material comprises cork.

9. The pickup as claimed in claim 7, wherein said solid material comprises rubber.

10. The pickup as claimed in claim 1, wherein said pickup body is insulated from sound vibrations of a body of the musical instrument.

11. The pickup as claimed in claim 1, wherein said pickup body is comprised of a sound-insulating material.

12. The pickup as claimed in claim 1, wherein said pickup body further comprises an exit port for a microphone cable.

13. The pickup as claimed in claim 12, wherein said microphone cable exit port includes an airtight seal such that air does not escape the pickup body via said microphone cable exit port.

14. The pickup as claimed in claim 1, wherein said membrane comprises a piezoelectric material.

15. The pickup as claimed in claim 1, wherein said pickup body further comprises an acoustic exit port.

16. The pickup as claimed in claim 15, wherein said acoustic exit port is operably connected to acoustic headphones via a flexible tube, such that sound vibrations of the musical instrument can travel from the musical instrument, through said connection member, through said membrane, through said pickup body, through said acoustic exit port, through said flexible tube, through said acoustic headphones to a listener, without electronic amplification or interference.

17. A pickup for a musical instrument comprising:

a pickup body with a cavity;

a membrane forming at least a portion of a wall of said cavity; and a connection member to directly connect the musical instrument to said membrane, wherein said pickup body further comprises a piezoelectric pickup device.

18. The pickup as claimed in claim 1, wherein said pickup body further comprises a back plate directly behind said membrane, within said pickup cavity, and rigidly affixed to said pickup body.

19. A method of using the pickup of claim 1, the method comprising:

connecting the connection member to a body of a musical instrument.

20. The method as claimed in claim 19, further comprising:

insulating the pickup body from vibrations of said body of said musical instrument with an insulating material.

21. The method as claimed in claim 20, wherein said insulating material is one of rubber, sponge, cotton, felt, fabric, foam or plastic.

22. The method as claimed in claim 19, further comprising:

directly connecting said connection member to a soundboard of the musical instrument.

23. The pickup as claimed in claim 1 wherein connection member comprises carbon fiber.

24. The pickup as claimed in claim 17, wherein said pickup body further comprises an acoustic exit port.

* * * * *